US006508587B1

(12) United States Patent
Byers, Jr.

(10) Patent No.: US 6,508,587 B1
(45) **Date of Patent: *Jan. 21, 2003**

(54) EASILY MANIPULATED CLOSURES FOR BAG-LIKE CONTAINERS, CONTAINERS INCORPORATING THE SAME, AND METHODS FOR MAKING SUCH CONTAINERS

(76) Inventor: James H. Byers, Jr., 23010 Lake Forest Dr., No. 271, Laguna Hills, CA (US) 92653

( * ) Notice: Subject to any disclaimer, the term of this patent is extended or adjusted under 35 U.S.C. 154(b) by 0 days.

This patent is subject to a terminal disclaimer.

(21) Appl. No.: 09/697,001

(22) Filed: Oct. 26, 2000

Related U.S. Application Data

(62) Division of application No. 09/248,362, filed on Feb. 10, 1999, now Pat. No. 6,234,674.

(51) Int. Cl.[7] ..... B65D 33/30; B65D 77/10

(52) U.S. Cl. ..... 383/33; 383/34; 24/30.5 R; 264/242

(58) Field of Search ..... 383/33, 34, 43, 383/68; 24/30.5 R, 30.5 P, 543; 264/242; 150/118, 120, 900; 190/106

(56) References Cited

U.S. PATENT DOCUMENTS

| | | | | | |
|---|---|---|---|---|---|
| 1,277,327 | A | * | 8/1918 | Lundqvist | 24/30.5 R |
| 1,338,375 | A | * | 4/1920 | Kleidman | 383/43 X |
| 2,040,271 | A | * | 5/1936 | Rosenzweig | 383/43 X |
| 2,074,843 | A | * | 3/1937 | Hiering | 383/43 X |
| 2,125,354 | A | * | 8/1938 | Meier | 150/900 |
| 2,150,627 | A | * | 3/1939 | Lieber | 383/43 X |
| 2,158,955 | A | * | 5/1939 | Blacher | 383/43 X |
| 2,817,379 | A | * | 12/1957 | Lamarthe | 383/34 X |
| 3,259,302 | A | * | 7/1966 | Rocchisani | 383/68 X |
| 3,292,223 | A | * | 12/1966 | Esposito, Jr. | 223/93 |
| 3,384,938 | A | * | 5/1968 | O'Connor | 24/461 |
| 3,512,227 | A | * | 5/1970 | Krawagna | 223/96 |
| 3,720,979 | A | * | 3/1973 | Krawagna | 16/227 |
| 4,069,994 | A | * | 1/1978 | Wharmby | 248/101 |
| 4,486,923 | A | * | 12/1984 | Briggs | 24/30.5 R |
| 4,753,489 | A | * | 6/1988 | Mochizuki | 383/68 X |
| 5,524,990 | A | * | 6/1996 | Buck | 383/34 |
| 5,609,419 | A | * | 3/1997 | Byers, Jr. | 383/33 |
| 6,234,674 | B1 | * | 5/2001 | Byers, Jr. | 383/33 |

FOREIGN PATENT DOCUMENTS

| | | | |
|---|---|---|---|
| AT | OE 0090181 | * 11/1922 | 150/118 |
| GB | 0017798 | * of 1913 | 383/43 |
| HU | 0111005 | * 11/1934 | 383/43 |

* cited by examiner

*Primary Examiner*—Jes F. Pascua
(74) *Attorney, Agent, or Firm*—Eric K. Satermo

(57) ABSTRACT

A container for retaining articles includes a pliable sack and a closure attached to an opening of the sack. The closure includes a substantially flexible member having a pair of anchors and a substantially rigid member having a pair of pivotal seats. Each of the pivotal seats is adapted to receive a respective one of the anchors of the flexible member. The closure is positionable between a closed position in which the flexible member is substantially proximate to the rigid member and an opened position in which the flexible member is substantially separated from the rigid member. The closure may be configured to have a generally circular shape when in the opened position and a generally crescent shape when in the closed position. The seats may be configured to slidably receive the anchors to minimize complexity in the manufacturing process. Each of the rigid and flexible members preferably has a unitary construction to further reduce manufacturing costs. In addition, the sack preferably has a configuration that reduces the bunching up of material when in the closed position to allow the sack to seal completely. The container is configured so that a user may open and close the container with one finger. Further, the container remains opened or closed until manually operated to close or open, respectively, the container.

14 Claims, 6 Drawing Sheets

FIG 17
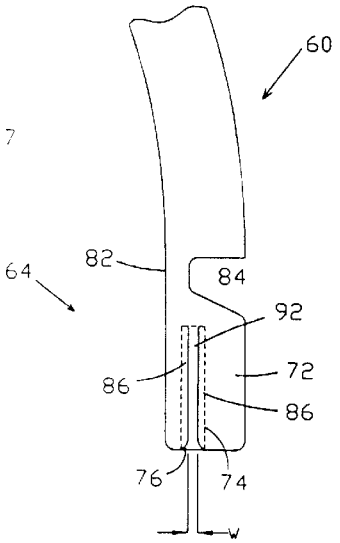
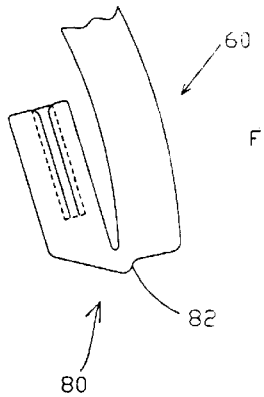
FIG. 18
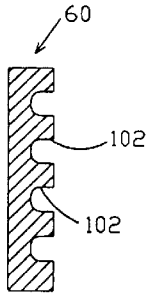
FIG. 22
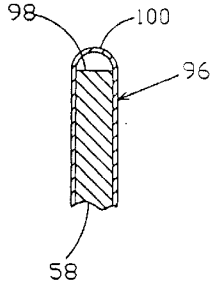
FIG. 21
FIG 19
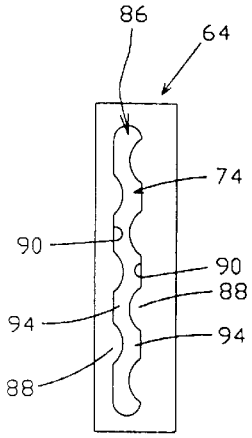
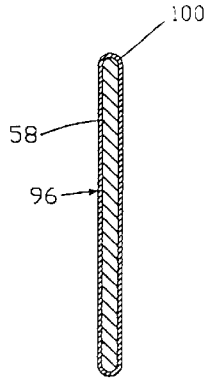
FIG. 20

EASILY MANIPULATED CLOSURES FOR BAG-LIKE CONTAINERS, CONTAINERS INCORPORATING THE SAME, AND METHODS FOR MAKING SUCH CONTAINERS

CROSS-REFERENCE TO RELATED PATENTS

The present application is a divisional application of U.S. patent application Ser. No. 09/248,362 filed Feb. 10, 1999, which issued as U.S. Pat. No. 6,234,674.

FIELD OF THE INVENTION

The present invention relates generally to containers for retaining articles and, more particularly, to containers with a closure mechanism that allows the containers to be repeatedly opened and closed. The closure mechanisms of the present invention are configured to enable actuation with only one hand.

BACKGROUND OF THE INVENTION

Containers or cases are used to carry many types of articles. For example, there are carrying cases for cellular phones, portable electronic appliances such as compact-disc (CD) players, and sunglasses. In addition, purses and wallets may be thought of as carrying cases for money and credit cards. The purpose of such containers is to conveniently carry a particular article and to protect the article from damage. Other containers are dedicated to carrying articles much different from those mentioned above. For example, chalk bags are used by rock climbers to carry chalk in an easily accessible manner.

The conventional containers mentioned above are designed quite specifically to carry a particular article. In addition, each container utilizes a specialized closure mechanism. It follows that the containers do not operate in accordance with a universal closure principle. If a single manufacturer were to fabricate a variety of containers, then each particular container would require a different and dedicated manufacturing process. Accordingly, the cost of manufacturing the containers in this situation would be high.

Regarding the closure mechanism itself, many of the closure mechanisms require two hands to operate which is undesirable in most circumstances. In addition, it is the closure mechanism that ordinarily wears out over time and breaks before other elements of the container. It is well known that by reducing the number of moving parts typically increases the reliability of a particular product.

In view of the foregoing, there remains a need in the art for a container that is easy and inexpensive to manufacture, and for a container with a reliable and streamlined closure mechanism.

BRIEF SUMMARY OF THE INVENTION

The present invention provides containers for retaining articles. The containers generally include a closure and a pliable sack. The closure may be easily toggled by a user, for example, with a single finger, between an opened position in which articles may be retrieved from the sack and a closed position in which articles are retained in the sack. The closure is configured to remain in the opened position and the closed position until manually actuated by the user. The container may be configured to retain a wide-range of articles, such as electronic and optical appliances, hand chalk, ammunition, and building fasteners, to name a few. The present invention further provides closures and sacks for such containers, as well as methods for manufacturing such containers. The closures are preferably comprised of only two elements, which increases the reliability, reduces the manufacturing costs, and simplifies the manufacturing process.

According to one aspect of the present invention, a container includes a sack with an opening and a closure attached to the sack at the opening. The closure includes a substantially flexible member having a pair of anchors and a substantially rigid member having a pair of pivotal seats. Each of the pivotal seats is adapted to receive a respective one of the anchors of the flexible member. The closure is positionable between a closed position in which the flexible member is substantially proximate to the rigid member, thereby rendering the opening of the sack closed, and an opened position in which the flexible member is substantially separated from the rigid member, thereby rendering the opening of the sack opened. The closure is preferably configured to have a generally circular shape when in the opened position and a generally crescent shape when in the closed position.

To operate the closure, a user only needs to employ a single finger to exert the force required to open and close the container. For example, to close the container, a user may press a finger against the flexible member to urge the flexible member toward the rigid member. In doing so, the flexible member flexes to a point at which the flexible member snaps against the rigid member. To open the container, a user may urge a finger between the flexible member and the rigid member, drawing the flexible member away from the rigid member. In doing so, the flexible member flexes to a point at which the flexible member snaps open.

Each of the pivotal seats of the rigid member may include a socket, and each of the anchors of the flexible member may include a tab, with the tabs being slidably receivable in a respective one of the sockets. With such a configuration, the fabrication of the closure is relatively straightforward. For example, the tabs may be urged into the sockets either manually or automatically with machinery. The sockets may include retaining structure for securing the tabs therein through the use of frictional forces. Accordingly, other than urging the tabs into the sockets, no other fabrication step is required. The manufacturing costs are therefore greatly reduced.

Further reducing the price of the containers of the present invention is that both the rigid member and the flexible member may have a unitary construction. For example, the rigid member, including the pivotal seats, may be injection molded, while the flexible member may be cut from a sheet of flexible material. Accordingly, the closure of the present invention may be made from only two unitary components each made in a single fabrication step.

Regarding the pivotal seats, the rigid member may include a pair of integral hinges disposed to render the seats pivotal through at least about 90 degrees. The hinges may be living hinges, that is, biased to be in either an opened or a closed position. The hinges are preferably integral with the rigid member, including the seats so that the rigid member may be fabricated in a single step to reduce costs.

Other aspects, features, and advantages of the present invention will become apparent to those skilled in the art from a consideration of the following detailed description taken in conjunction with the accompanying drawings.

BRIEF DESCRIPTION OF THE SEVERAL VIEWS OF THE DRAWINGS

FIG. 17 is an enlarged fragmentary view of pivotal seat of a rigid member of the present invention;

FIG. 18 is a view similar to that of FIG. 17, particularly illustrating the pivotal seat rotated through more than 90 degrees;

FIG. 19 is a schematic view of a socket of the pivotal seat of FIG. 18, particularly illustrating retaining structure of the socket;

FIG. 20 is a cross-sectional view of an exemplary flexible member of the invention including resilient cushioning material;

FIG. 21 is an enlarged fragmentary cross-sectional view of an edge of the flexible member of FIG. 20;

FIG. 22 is a cross-sectional view of an exemplary rigid member of the present invention;

DETAILED DESCRIPTION OF THE INVENTION

Figure 1:
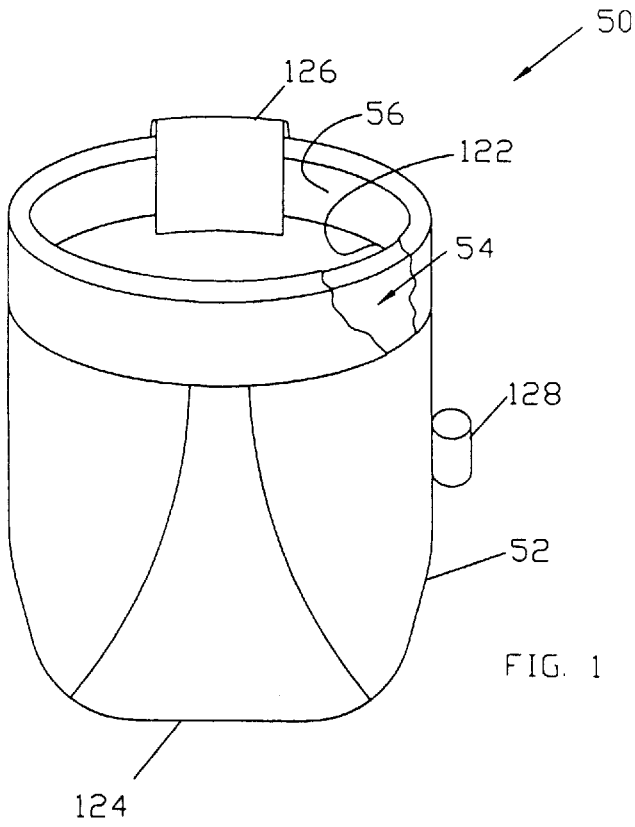
FIG. 1 is a perspective view of an exemplary container in accordance with the present invention, particularly illustrating the container in an opened position.
Figure 2:
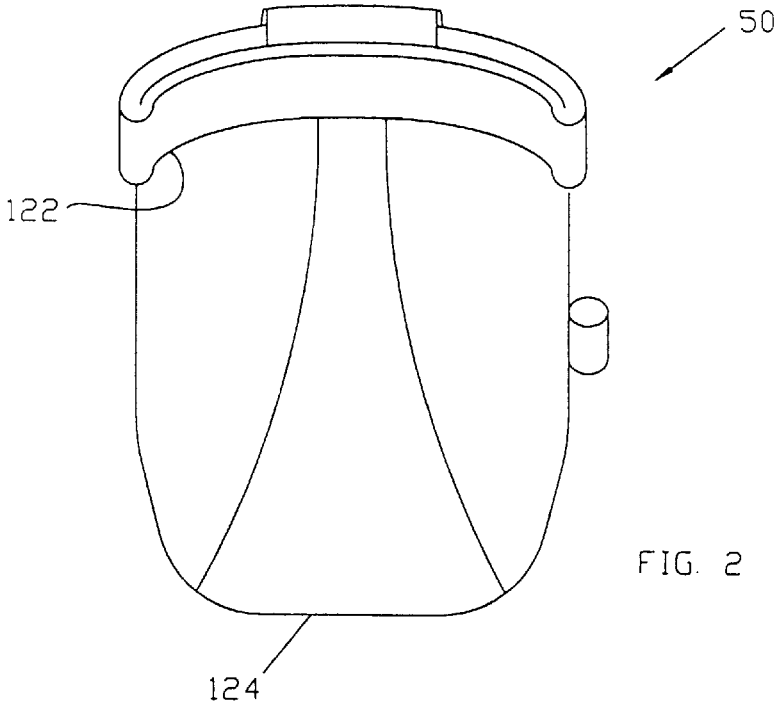
FIG. 2 is a perspective view of the container of FIG. 1 shown in a closed position.

Referring more particularly to the drawings, an exemplary container 50 of the present invention is illustrated in FIGS. 1 and 2. For purposes of explanation and without limiting the scope of the present invention, exemplary container 50 is illustrated as a chalk bag for rock climbing. However, the principles of the present invention are applicable to other rock-climbing embodiments of the container, such as bags for holding rope and other accessories. Exemplary container 50 may also be configured as a bag for hold electronic or optical equipment, such as bags for holding cellular phones, compact disc (CD) and tape players, microcassette recorders, binoculars, cameras, camera lenses, and sunglasses. Exemplary container 50 may also be configured to as a bag for holding equipment and accessories in varied sporting activities, such as ammunition for hunters, balls and tees for golfers, and bait for fishermen. In addition to sporting activities, exemplary container 50 may be configured for the trades, such as bolt bags for riggers, bags for screws, nails, and fasteners for construction, and bait bags for animal trainers.

Exemplary container 50 generally includes a sack 52 and a closure 54 attached to an opening 56 of the sack 52. As will be discussed in more detail below, the operation of the closure 54 by a user allows the opening 56 of the sack 52 to be opened as shown in FIG. 1, thereby providing access to the sack 52, and to be closed as shown in FIG. 2, thereby retaining an article or articles within the sack 52.

Figure 3:
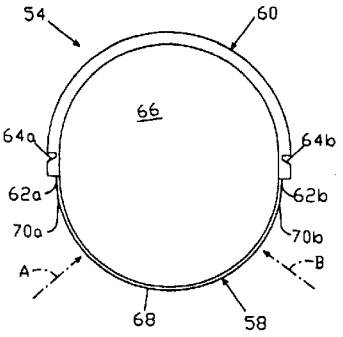
FIG. 3 is a schematic view of an exemplary closure of the present invention, particularly illustrating the closure in an opened position.

With additional reference to FIG. 3, exemplary closure 54 generally includes a substantially flexible member 58 and a substantially rigid member 60. Exemplary flexible member 58 may be made from or may include flexible or resilient material such as, for example, rubber or plastic. Alternatively, exemplary flexible member 58 may be made from or may include, for example, a band of resilient metal. Exemplary rigid member 60 may be made from or may include rigid or nonresilient material, or may be relatively thick so that the rigid member does not substantially flex or bend under forces inflicted during normal use. The flexible and rigid members 58 and 60 will be discussed in more detail below.

With particular reference to FIG. 3, exemplary flexible member 58 has a pair of anchors 62*a* and 62*b*, and exemplary rigid member 60 has a pair of pivotal seats 64*a* and 64*b*. For the purposes of this description, a number of elements of the invention are indicated generally with a numeral (e.g., anchors 62) and specifically with an alpha suffix (e.g., anchor 62*a* and anchor 62*b* ). Each of the pivotal seats 64 of the rigid member 60 is adapted to receive a respective one of the anchors 62 of the flexible member 58. Details of the anchors 62 and the pivotal seats 64 will be discussed below. Closure 54 is shown in an opened position in FIG. 3, defining a generally circular opening 66, and is biased to remain in the opened position until closed by a user.

Figure 4:
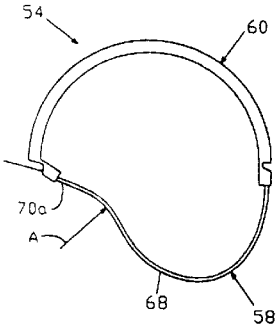
FIG. 4 is a schematic view of the closure of FIG. 3, particularly illustrating the closure in the process of being closed.
Figure 5:
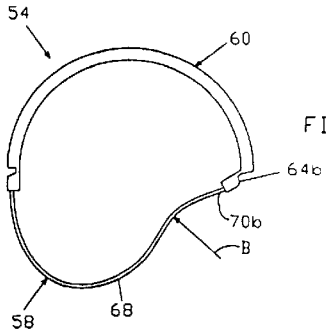
FIG. 5 is a schematic view of the closure of FIG. 3, particularly illustrating an alternative closing process.
Figure 6:
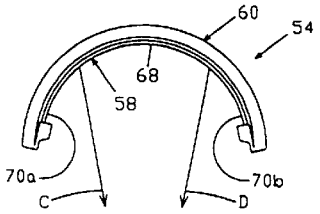
FIG. 6 is a schematic view of the closure of FIG. 3, particularly illustrating the closure in a closed position.

Referencing FIGS. 4 and 5, to close the closure 54, force is applied on the flexible member 58 at a position preferably between a center 68 thereof and either end 70*a* or end 70*b* thereof. Specifically, as shown in FIG. 4, an inward force indicated by arrow A (which is shown in phantom line in FIG. 3) may be applied to the flexible member 58 between the center 68 and end 70*a*, thereby deflecting the flexible member 58 and causing pivotal seat 64*a* of the rigid member 60 to rotate inwardly. Alternatively, as shown in FIG. 5, an inward force indicated by arrow B (which is also shown in phantom line in FIG. 3) may be applied to the flexible member 58 preferably between the center 68 and end 70*b*, thereby deflecting the flexible member 58 and causing pivotal seat 64*b* of the rigid member 60 to rotate inwardly. In either case, the flexible member 58 deflects toward the rigid member 60 through a serpentine shape to a point at which the flexible member snaps against the rigid member 60 to a closed position as shown in FIG. 6. The forces indicated by arrows A and B may be applied by the user with a single finger. Closure 54 is biased to remain in the closed position until opened by a user.

Figure 7:
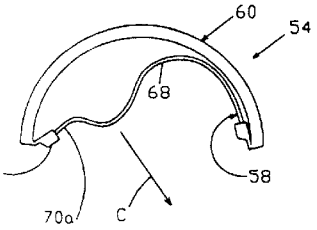
FIG. 7 is a schematic view of the closure of FIG. 3, particularly illustrating the closure in the process of being opened.
Figure 8:
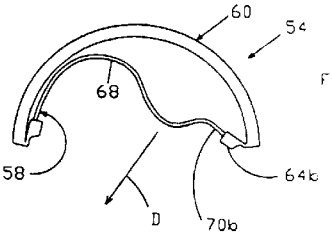
FIG. 8 is a schematic view of the closure of FIG. 3, particularly illustrating an alternative opening process.

Referencing FIGS. 7 and 8, to open the closure 54, force is applied on the flexible member 58 at a position between the center 68 and either of the ends 70 thereof. Specifically, as shown in FIG. 7, an outward force indicated by arrow C (which is shown in phantom line in FIG. 6) may be applied to the flexible member 58 preferably between the center 68 and end 70*a*, thereby deflecting the flexible member 58 and causing pivotal seat 64*a* of the rigid member 60 to rotate outwardly. Alternatively, as shown in FIG. 8, an outward force indicated by arrow D (which is also shown in phantom line in FIG. 6) may be applied to the flexible member 58 preferably between the center 68 and end 70*b*, thereby deflecting the flexible member 58 and causing pivotal seat 64*b* to rotate outwardly. In either case, the flexible member 58 deflects away from the rigid member 60 through a serpentine shape to a point at which the flexible member snaps away from the rigid member 60 to the opened position shown in FIG. 9 (and in FIG. 3). As was the case for the closing process, the forces indicated by arrows C and D may be applied by the user with a single finger. For example, a user may urge a finger between the flexible member 58 and the rigid member 60 to apply the outward force.

Figure 9:
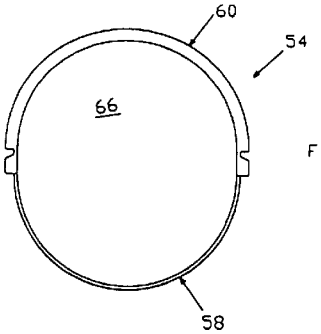
FIG. 9 is a schematic view similar to that of FIG. 3, illustrating the closure in the opened position.

With continued reference to FIGS. 3–9, generally speaking, the closure 54 is positionable between the closed position shown in FIG. 6 in which the flexible member 58 is substantially proximate to the rigid member 60, thereby rendering the opening 66 closed, and the opened position shown in FIGS. 3 and 9 in which the flexible member 58 is substantially separated from the rigid member 60, thereby rendering the opening 66 opened. The proximity of the flexible member 58 with the rigid member 60 when in the closed position does not necessarily need to be along the substantial length of the flexible member 58 as shown, but may be along only a portion of or a partial length of the flexible member 58, a partial length which allows the opening 66 to be closed sufficiently to retain articles within the sack 52. Similarly, the separation of the flexible member 58 from the rigid member 60 when in the opened position does not necessarily need to be along the substantial length of the flexible member 58 as shown, but may be along only a portion of or a partial length of the flexible member, a partial length which allows the opening 66 to be opened sufficiently to allow articles to be put into or retrieved from the sack 52.

As shown in the drawings, the closure 54 has a shape when in the opened position and another shape when in the closed position. In the exemplary embodiment shown, the closure 54 is substantially circular when in the opened positioned and substantially crescent shaped when in the closed position. As shown in FIG. 6, the flexible member 58 may substantially correspond to the shape of the rigid member 60 when in the closed position, with the shape of the rigid member 60 being arcuate or, more specifically, semicircular. As shown in FIGS. 3 and 9, the flexible member 58 may be substantially a mirror image of the rigid member 60 when in the opened position; that is, the flexible member 58 may be also arcuate or semicircular.

Figure 10:
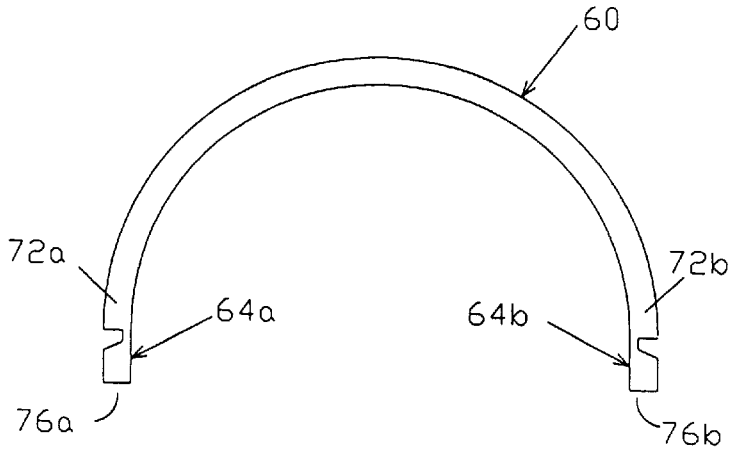
FIG. 10 is a top view of an exemplary rigid member of a closure of the present invention.
Figure 11:
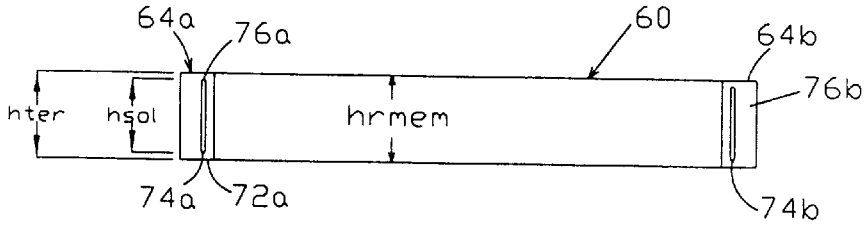
FIG. 11 is a side view of the rigid member of FIG. 10.

With additional reference to FIGS. 10 and 11, exemplary rigid member 60 is shown in more detail. Exemplary rigid member 60 has a pair of terminuses 72*a* and 72*b*, with each of the pivotal seats 64*a* and 64*b* being disposed on a respective on of the terminuses 72. Each of the pivotal seats 64*a* and 64*b* may include a socket 74*a* and 74*b*, respectively. More specifically, each of the terminuses 72*a* and 72*b* has an end surface 76*a* and 76*b*, with each of the sockets 74 extending within a respective one of the terminuses 72 from the end surface 76 thereof.

Figure 12:
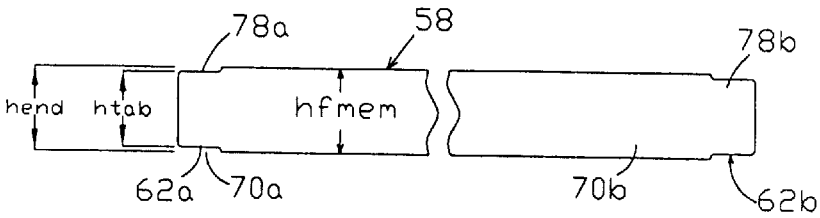
FIG. 12 is a side view of an exemplary flexible member of a closure of the present invention, particularly a flexible member configured to engage with the rigid member of FIG. 10.

With additional reference to FIG. 12, exemplary flexible member 58 is shown in more detail. Each of the anchors 62*a* and 62*b* of exemplary flexible member 58 may include a tab 78*a* and 78*b*, respectively. Each of the sockets 74 is adapted to receive a respective one of the tabs 78 therein. As shown in the drawings, each of the tabs 78 may be substantially planar, so that the tabs 78 are slidably receivable in a respective one of the sockets 74.

Figure 13:
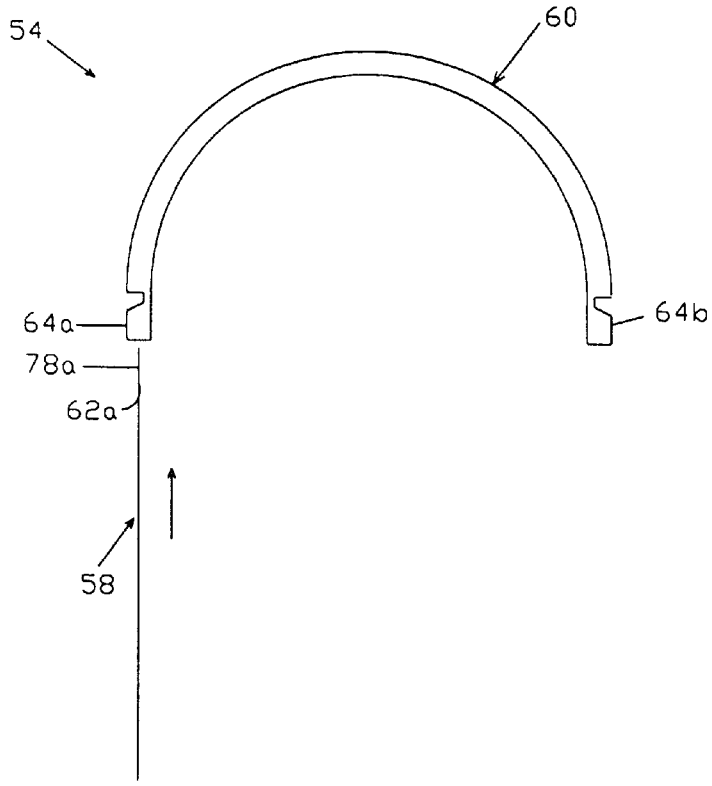
FIG. 13 is a schematic view of a rigid member and a flexible member of a closure of the invention, particularly illustrating a step in a fabrication process.

This slidable engagement enables the closure 54 to be fabricated easily and inexpensively. More specifically, with additional reference to FIG. 13, in the exemplary embodiment shown, with the closure 54 including only two components (i.e., the flexible and rigid members 58 and 60), one of the tabs 78 (i.e., tab 78*a* as shown) may be engaged with socket 74 (not shown) of one of the pivotal seats 64 (i.e., pivotal seat 64*a* ), preferably by urging or sliding in the direction shown by the arrow.

Figure 14:
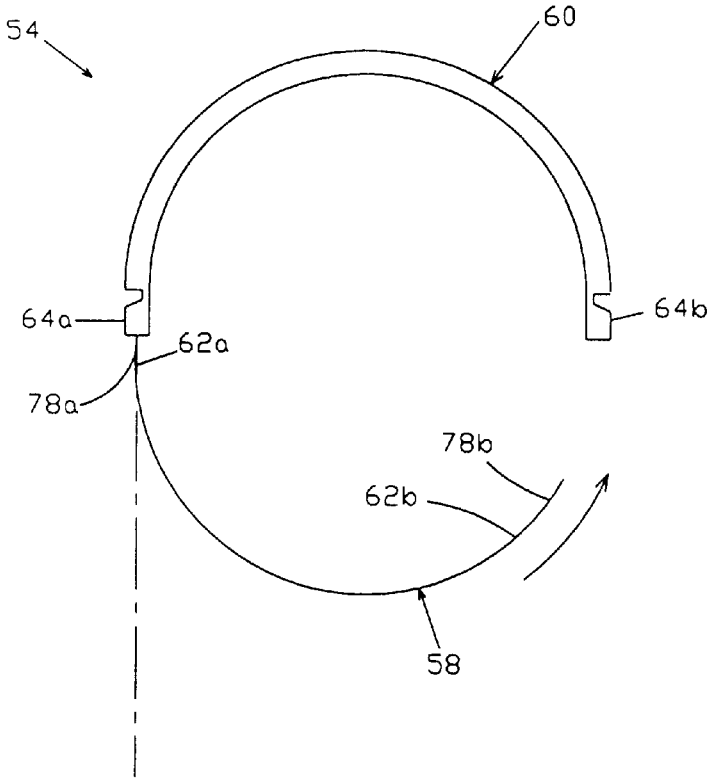
FIG. 14 is a view similar to that of FIG. 13, particularly illustrating a further step of a fabrication process.

With additional reference to FIG. 14, the flexible member 58 may then be deflected from a normal linear configuration thereof, which linear configuration is shown in phantom line, to draw the other tab 78 (i.e., tab 78*b* ) toward the socket of the other pivotal seat 64 (i.e., seat 64*b* ). The deflection of the flexible member 58 from the normal linear configuration biases the flexible member and stores elastic potential energy. More specifically, when deflected (within the elastic limit of the flexible member), the flexible member 58 acts as a spring applying elastic potential energy equal to the work performed in deflecting the flexible member. This streamlined fabrication process for exemplary closure 54 reduces production costs over conventional fabrication techniques. The process may be done manually or, more preferably, with automated machinery.

With additional reference to exemplary rigid member 60 shown in FIG. 11, the sockets 74 have a height $h_{soc}$, and the terminuses 72 have a height $h_{ter}$, with the portion between the terminuses 72 having a height $h_{rmem}$. With additional reference to exemplary flexible member 58 shown FIG. 12, the tabs 78 have a height $h_{tab}$, the ends 70 have a height $h_{end}$, with the portion between the ends 70 having a height $h_{frem}$. For exemplary rigid member 60 shown in FIG. 11, the height of the sockets $h_{soc}$ is less than the height of the terminuses $h_{ter}$, with the height of the terminuses $h_{ter}$ being substantially equal to the height between the terminuses $h_{rmem}$. For exemplary flexible member 58 shown in FIG. 12, the height of the tabs $h_{tab}$ is less than the height of the ends $h_{end}$, with the height of the ends $h_{end}$ being substantially equal to the height between the ends $h_{fmem}$. For engagement between the anchors 62 and the seats 64, the height $h_{soc}$ of the sockets 74 is greater than or equal to the height $h_{tab}$ of the tabs 78. Furthermore, in the exemplary embodiment shown, the height $h_{ter}$ of the terminuses 72 and the height $h_{rmem}$ the portion therebetween of the rigid member 60 are substantially equal to the height $h_{end}$ of the ends 70 and the height $h_{fmem}$ the portion therebetween of the flexible member 58 so that the rigid member 60 is substantially continuous with a respective one of the ends of the flexible member when the sockets respectively receive the tabs.

Figure 15:
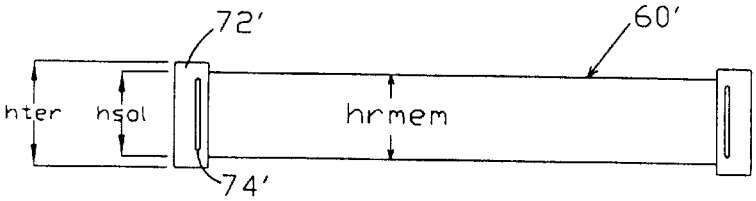
FIG. 15 is a side view of an alternative exemplary rigid member of a closure of the present invention.
Figure 16:
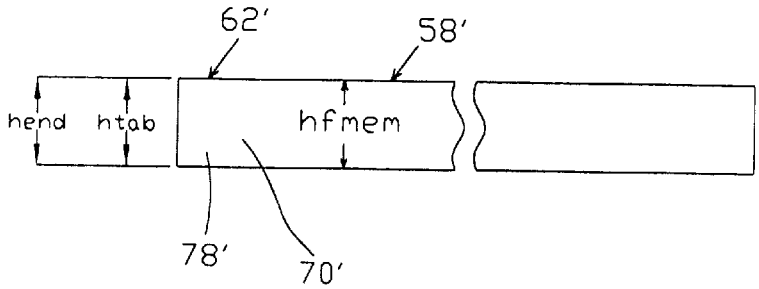
FIG. 16 is a side view of an alternative exemplary flexible member of a closure of the present invention, particularly a flexible member configured to engage with the rigid member of FIG. 15.

Alternative embodiments of the rigid and flexible members are respectively shown in FIGS. 15 and 16, which are indicated by like reference numerals with the addition of a prime (′). For exemplary rigid member 60′ shown in FIG. 15, the height $h_{soc}$ of the sockets 74′ is less than the height $h_{ter}$ of the terminuses 72', with the height of the terminuses $h_{ter}$ being greater than the height between the terminuses $h_{rmem}$. For exemplary flexible member 58' shown in FIG. 12, the height $h_{tab}$ of the tabs 78' is substantially equal to the height $h_{end}$ of the ends 70', with the height of the ends $h_{end}$ also being substantially equal to the height between the ends $h_{fmem}$. Further alternative embodiments of the rigid and flexible members of the invention are possible, not only by varying the heights of the various elements as described above but also by varying the shape and configuration of the elements. Regardless of a particular embodiment, exemplary flexible member 58 (and 58') may be made relatively inexpensively, for example, by stamping or die cutting the flexible member from a sheet or a roll of metal, for example, 0.01 0-inch tempered steel such as 1090 carbon steel.

Details of the pivotal seats 64 of the rigid member 60 are shown in more detail in FIGS. 17 and 18. Each of the pivotal seats 64 includes a hinge 80 disposed proximate to the socket 74. Each hinge 80 includes a strip 82 connecting the seat 64 to the remainder of the rigid member 60. In addition, each hinge 80 has a notch 84 defined between the seat 64 and the remainder of the rigid member 60 when the flexible member 58 (not shown) is in the opened position. Accordingly, each hinge 80 is pivotal through at least about 90 degrees and, more particularly, through about 180 degrees. Each of the hinges 80 is preferably a living hinge. That is, each hinge 80 may be biased to be either opened, as shown in FIG. 17, or closed, as shown in FIG. 18.

The hinges 80 are preferably integral features of the rigid member 60 and, accordingly, made from the same material as the rigid member 60. Such construction enables the rigid member 60 to have a unitary construction and to be manufactured economically with minimal manual labor. For example, the rigid member 60 including the hinges 80 and the pivotal seats 64 may be formed by injection molding, for example, with polypropylene.

With continued reference to FIG. 17 and additional reference to FIG. 19, each of the sockets 74 may include retaining structure 86 for securing or retaining in the socket a respective one of the tabs 78 of the flexible member 58 (not shown). Preferably, the retaining structure 86 secure the ends 70 of the flexible member 58 through the use of friction. More specifically, the retaining structure 86 may be in the form of protrusions 88 disposed on opposing walls 90 of the socket 74. An inner slot 92 is defined between the protrusions 88, which inner slot 92 has a width w. The width w of each inner slot 92 is less than the thickness of the flexible member 58 or, more particularly, than the thickness of the tabs 78 so that the tabs 78 need to be urged into the sockets 74 against the frictional forces applied by the protrusions 88 thereon.

As shown in FIG. 19, the protrusions 88 may alternate with each along a respective wall 90 of the socket 74, thereby defining gaps 94. The protrusions 88 along one wall 90 are positioned opposite to the gaps 94 along the other wall. Accordingly, when the tabs 78 are received in the sockets 74, each protrusion 88 causes the tab 78 to flex toward an opposing gap 94. As the protrusions 88 and the gaps 94 alternate, the frictional forces applied on the tabs 78 in opposite (normal) directions securely retains the tabs 78 within the sockets 74.

With particularly reference to FIG. 17, to facilitate the insertion of the tabs 78 into the sockets 74, each of the end surfaces 76 of the terminuses 72 of the rigid member 60 may be funnel shaped, that is, tapered toward the inner slot 92. Accordingly, when fabricating the closure 54, it is not necessary to precisely align the tabs 78 with the inner slots 92. Rather, the tabs 78 only need to be approximately aligned with the end surfaces 76, which then guide the tabs 78 into the inner slots 92 as the tabs 78 are urged into the sockets 74.

Referencing FIGS. 20 and 21, the flexible member 58 may include resilient material 96 disposed at least at edges 98 thereof, as shown in detail in FIG. 21. More specifically, the flexible member 58 may be encased in resilient material 96, as shown in FIG. 20. The resilient material 96 forms cushions 100 at the edges 98 of the flexible member 58. The cushions 100 resiliently prevent the edges 98 from abrading or cutting the material of the sack 52 (see FIG. 1), thereby extending the life of the container 50. The resilient material 96 may be plastic material attached about the flexible member 58. For example, the resilient material 96 may be heat shrinkable plastic material. Alternatively, resilient material 96 may be a self-adhering tape, hot-dipped plastic, or other analogous material.

With reference to FIG. 22, the rigid member 60 may include a plurality of notches 102 formed therein. By configuring the rigid member 60 in such a manner, less material is required for forming the rigid member 60, thereby reducing fabrication costs. In addition to reducing the cost, the notches 102 increase the rigidity of the rigid member 60 while decreasing the weight.

Figure 24:
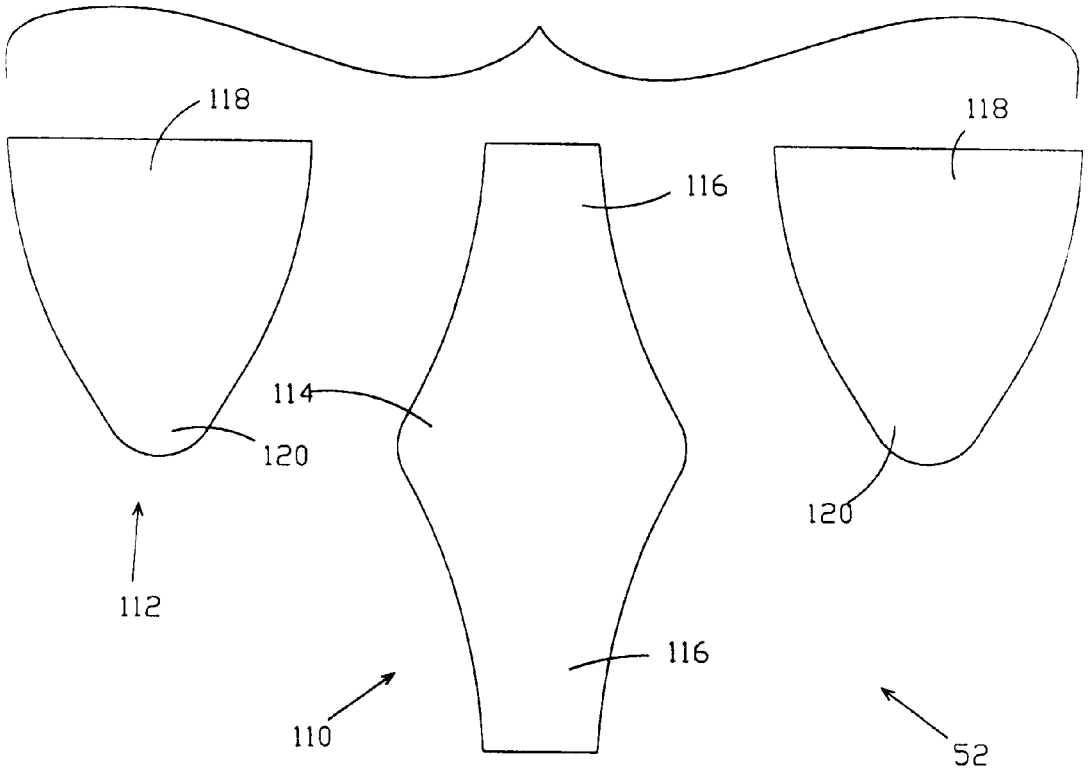
FIG. 24 is a schematic exploded view of an exemplary bag of the present invention.
Figure 23:
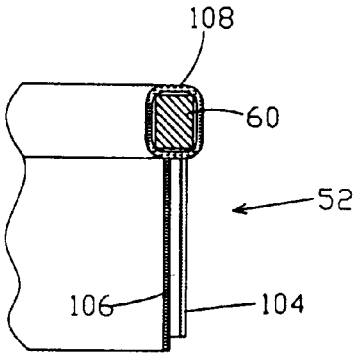
FIG. 23 is a cross-sectional view of an exemplary bag of a container of the invention attached to a closure.

Exemplary sack 52 of the container 50 is shown in detail in FIG. 23. Exemplary sack 52 may include an outer layer 104 and an inner layer 106, as well as a retaining portion 108 sewn about the flexible member 58. With additional reference to FIG. 24, the outer layer 104 may include a central panel 110 and a pair of side panels 112. The central panel 110 has a center portion 114 and a pair of tapered end portions 116. Each of the side panels 112 has a broadened end 118 and a narrowed end 120. The panels 110 and 112 are connected together such that the tapered end portions 116 of the central panel 110 are sandwiched between the broadened ends 118 of the side panels 112 to define an opening. The opening is indicated by numeral 122 in FIGS. 1 and 2 and is sewn to the retaining portion 108 for attaching the sack 52 to the closure 54. When connected, the center portion 114 of the central panel 110 is sandwiched between the narrowed ends 120 of the side panels 112 to define abottom of the sack. The bottom is indicated by numeral 124 in FIGS. 1 and 2. The inner layer 106 of the sack 52 may be formed in a manner analogous to the outer layer 104. Although a specific exemplary embodiment is shown in the drawings, the sack 52 may be alternatively configured to satisfy a particular holding need, as those skilled in the art will appreciate.

The sack 52 (or either of the layers 104 and 106) may be made from fibrous material, either natural fiber such as cotton or synthetic fiber such as nylon. Alternatively, the sack 52 or the outer layer 104 thereof may be made from water-resistant material such as rubber or Gortex®. The sack 52 or the outer layer 104 thereof may also be made from animal skins such as leather. In addition, the sack 52 may include floatation material so that the container 50 will float in water. The floatation material may be disposed between the outer and inner layers 104 and 106. Alternatively, the outer layer 104 may be made from buoyant material. Furthermore, either of the layers 104 and/or 106 may be substantially plush to provide protection for article(s) within the sack 52.

One of the drawbacks of conventional bags with circular openings is that the material of the bags bunches up when the opening is closed, for example, a cloth bag with a drawstring opening. The bunching up of material is not only a nuisance and unsightly but also prevents the bags from sealing effectively, so that articles may dislodge from the bag, thereby limiting the functionality thereof. Exemplary sack 52 of the present invention overcomes this problem with the configuration of the central panel 110 and the pair of side panels 112. As shown in FIG. 1, when the container 50 is in the opened position, the sack 52 has the circular opening 122. When the container 50 is in the closed position as shown in FIG. 2, the bottom 124 of the sack 52 is drawn only slightly upward toward the closure, thereby minimizing the bunching of the material of the sack 52 and allowing the sack 52 to close completely and to form a tight seal.

With further reference to FIGS. 1 and 2, the container 50 of the present invention may include a component for securing the container 50 to the user, such as a strap 126. In addition, the container 50 may include an accessory holder 128. For example, if the container 50 is configured as a chalk bag for rock climbers, the strap 126 may be designed to receive a belt, while the accessory holder 128 may be designed to hold a small brush. Alternatively, if the container 50 is configured to hold a camera, the strap 126 may again be designed to receive a belt, while the accessory holder may be designed to hold a roll of film. Alternatively, the container 50 may include a belt clip. As mentioned above, the container 50 may be configured to retain many different articles, from electronic or optical equipment such as cassette recorders and cameras to sporting equipment such as ammunition and golf balls. In addition, the container 50 may be configured as a collapsible food bowl for animals. The container 50 may be further configured as personal accessories such as make-up cases, purses, and wallets for holding everyday items such as cigarettes, lighters, keys, credit cards, cash, and so on.

Those skilled in the art will understand that the present invention is not limited to the embodiments specifically illustrated in the drawings and described above. Rather, the scope of the present invention is determined by the terms of the appended claims and their legal equivalents.

What is claimed is:

1. A closure for a container, the closure comprising:

a flexible member including a pair of anchors; and a rigid member including a pair of pivotal seats for respectively receiving the anchors, the rigid member and the seats having a unitary construction.

2. A closure as claimed in claim 1 wherein the rigid member includes a pair of hinges respectively disposed proximate to the seats.

3. A closure as claimed in claim 2 wherein each of the hinges includes a strip connecting the seat to the remainder of the rigid member.

4. A closure as claimed in claim 3 wherein each of the hinges has a notch defined between the seat and the remainder of the rigid member.

5. A closure for a container, the closure comprising:

a flexible member including a pair of anchors; and a rigid member including a pair of seats for respectively receiving the anchors and a pair of living hinges respectively disposed proximate to the seats.

6. A closure as claimed in claim 5 wherein the hinges are biased to be opened.

7. A closure as claimed in claim 5 wherein the rigid member has a unitary construction.

8. A closure as claimed in claim 5 wherein the flexible member has a unitary construction.

9. A closure for a container, the closure comprising:

a flexible member including a pair of anchors; and a rigid member including a pair of pivotal seats for respectively receiving the anchors;

each of the seats being positionable between a closed position in which the seat is proximate to the rigid member and an opened position in which the seat is separated from the rigid member;

the seats being biased to be in the opened position; and the rigid member having a unitary construction.

10. A closure for a container, the closure comprising:

a flexible member including a pair of anchors; and a rigid member including a pair of pivotal seats for respectively receiving the anchors;

each of the seats being positionable between a closed position in which the seat is proximate to the rigid member and an opened position in which the seat is separated from the rigid member;

the seats being biased to be in the opened position;

the rigid member including a pair of hinges respectively disposed proximate to the seats; and each of the hinges being a living hinge.

11. A closure for a container, the closure comprising:

a flexible member including a pair of anchors; and a rigid member including a pair of pivotal seats for respectively receiving the anchors;

each of the seats being positionable between a closed position in which the seat is proximate to the rigid member and an opened position in which the seat is separated from the rigid member;

the seats being biased to be in the opened position;

the rigid member including a pair of hinges respectively disposed proximate to the seats; and each of the hinges having a notch defined between the seat and the remainder of the rigid member when the seat is in the opened position.

12. A container comprising:

a sack including an opening; and a closure attached to the opening and including:

a flexible member including a pair of anchors; and a rigid member including a pair of pivotal seats for respectively receiving the anchors, the rigid member and the seats having a unitary construction.

13. A container comprising:

a sack including an opening; and a closure attached to the opening and including:

a flexible member including a pair of anchors; and a rigid member including a pair of seats for respectively receiving the anchors and a pair of living hinges respectively disposed proximate to the seats.

14. A method of making a container, the method comprising:

providing a sack with an opening;

providing a closure including:

a flexible member including a pair of anchors; and a rigid member including a pair of pivotal seats for respectively receiving one of the anchors, the rigid member and the seats having a unitary construction; and attaching the closure to the sack at the opening.

* * * * *